United States Patent [19]

Hirt

[11] 4,118,170

[45] Oct. 3, 1978

[54] APPARATUS AND METHOD OF CONTROLLING GASOLINE VAPOR EMISSIONS

[75] Inventor: John H. Hirt, Monterey Park, Calif.

[73] Assignee: Hirt Combustion Engineers, Montebello, Calif.

[21] Appl. No.: 771,573

[22] Filed: Feb. 24, 1977

Related U.S. Application Data

[63] Continuation-in-part of Ser. No. 603,002, Aug. 8, 1975, Pat. No. 4,009,985.

[51] Int. Cl.[2] ..... F23G 7/06

[52] U.S. Cl. ..... 431/5; 431/202; 422/168

[58] Field of Search ..... 431/5, 202, 12, 89, 431/90, 283, 285; 23/277 C; 220/85 VR, 85 VS

[56] References Cited

U.S. PATENT DOCUMENTS

| | | | |
|---|---|---|---|
| 3,817,687 | 6/1974 | Cavallero et al. | 431/202 |
| 3,897,193 | 7/1975 | Kattan et al. | 431/5 |
| 3,914,095 | 10/1975 | Straitz | 431/202 |
| 3,993,936 | 12/1976 | Hasselmann | 431/202 |

*Primary Examiner*—Edward G. Favors
*Attorney, Agent, or Firm*—Poms, Smith, Lande & Glenny

[57] ABSTRACT

An apparatus and method of controlling and abating gasoline vapor emissions which occur at a gasoline service station during transfer of liquid gasoline from a gasoline supply tank truck to underground storage tanks at the station and also during transfer of liquid gasoline from the underground storage tanks to the gasoline tank of an automobile through a service station gasoline pump. Vent outlet pipes of the underground storage tanks are manifolded to a common vent pipe where vapor pressure is sensed by a plurality of preset pressure sensing means to direct vapors from the vent pipe to a burner means under predetermined below atmospheric pressure or vacuum conditions. A compressed air source provides pressure air for directing the gasoline vapors to the burner means as by suction pumping and to also actuate valve means in the gas vapor line to permit flow of vapors to the burner means. A pilot system for the burner means is also provided which includes the use of gasoline vapors from the vent line and an air actuated valve for causing the vapors to move to the pilot burner. The burner means is a multistage burner in which one or both of the burners are operable depending upon the pressure vacuum condition in the vent line as sensed by the plurality of pressure sensing devices. An apparatus and method in which safety features are provided; for example, failure or absense of pressure air will prevent flow of vapors to an air booster means and to the burner means.

11 Claims, 5 Drawing Figures

OFF
GASOLINE PILOT
AUX. FUEL PILOT
PWR.
PILOT START
REMOTE ALARM
RELAYS
GASOLINE PUMPS
POWER
102
103
104
105
106
107
108
108a
109
109c
110
110b
111
111b
112
114
115
116
117
118
119
119a
119b
120
120a
121
122
123
124
125
130
130a
130b
131
131a
131b
132
132a
132b
134
135
137
137a
138
138a
138b
40
50
30
T20
T10
50
61
61a
61b
65
75
77
79
80
52
53
54
55

APPARATUS AND METHOD OF CONTROLLING GASOLINE VAPOR EMISSIONS

This application is a continuation in part of copending application on a METHOD AND APPARATUS FOR ABATEMENT OF GASOLINE VAPOR EMISSIONS Ser. No. 603,002 filed Aug. 8, 1975 now U.S. Pat. No. 4,009,985.

BACKGROUND OF THE INVENTION

The transfer of liquid gasoline from one container to another container produces gasoline rich vapors which are normally displaced into the atmosphere as the container is filled. Such transfers occur daily at gasoline service stations, both during the transfer of gasoline from a bulk tank truck to an underground storage tank at the station and thence from the underground storage tank through its gasoline pumps to an automobile tank. Gasoline vapor losses at the service station principally arise from the underground storage tank, which is subjected to both breathing and displacement losses. Breathing losses are caused by alternate expansion and contraction of the tank contents due to day-night temperature differentials. Such temperature differentials are minimized by using buried tanks at gasoline storage stations. Displacement losses occur upon refilling a partially empty or empty storage tank which normally expels an equivalent volume of vapor into the atmosphere through the vent pipe of the storage tank.

If gasoline vapors contained in a storage tank above the liquid level of the tank are continuously replaced with fresh air, it is possible to vaporize a very large amount of liquid gasoline. In an automobile fuel tank, air replaces the volume of fuel consumed during driving. This tank air volume will be the sole source of air to replace liquid and vapors in the preceding storage tank from which liquid gasoline was drawn to fill the automobile tank; that is, the storage tank at the gas station. At the service station, vapors from the automobile fuel tank could ultimately be transferred through the storage tank to the emptied gasoline truck for return to the refinery ethyl.

In the event an automobile tank is refueled directly from a delivery truck tank which is normally vapor tight, the delivery tank will obtain its displacement vapor only from the vapor space of the automobile tank as the fuel is dispensed. Thus, from the automobile tank to the delivery tank, liquid is being exchanged for gasoline saturated vapor volume. If the two tanks are at the same temperature, then the exchange of volume will be on a one to one basis. But if the delivery tank temperature is higher, and colder tank displaced vapors come to equilibrium temperature, then all of the vapor from the automobile tank will not fit in expanded condition into the delivery tank and excess vapor will escape into the atmosphere as a vapor loss. If the delivery tank is cooler, then the vapors transferred to the delivery tank will contract and outside air must be sucked into the vent line of the delivery tank, or gas vaporized, or the tank pressure remains below atmosphere pressure to make up the difference in volume.

Prior to vapor controlled systems and when an automobile fuel tank had only one or two gallons of gasoline remaining, this small amount of gasoline was considered to be highly "weathered" because of engine heat, high agitation and vehicle tank ventilation. By "weathered" is meant that the gasoline has lost some of its more volatile components. Vapor space in the automobile tank is saturated with respect to volatile components and their mole fractions in the liquid and vapors. When the automobile tank is filled with fresh gasoline, more gasoline vapors are produced as gasoline is used reflecting the changed composition of the fresh gasoline. Volume of vapors discharged from the vehicle tank during refueling may be from 2% to 15% greater than the liquid volume of the gasoline dispensed. Various prior proposed sytems have been used to cope with this problem including vapor balanced transfer systems where liquid and vapor spaces are connected together between two containers in which liquid is to be transferred, absorption with lean oil, high pressure compression systems, adsorption of hydrocarbon vapors on activated charcoal, refrigeration of saturated vent gasses, compression and refrigeration of the vent gasses, and combustion devices to dispose of residual hydrocarbons in vented gasses.

SUMMARY OF INVENTION

The present invention contemplates a method and apparatus for abatement of gasoline vapor emissions at a service station or any location where liquid gasoline is transferred from one container to another and particularly relates to certain modifications and additional safety features in the apparatus and method of abatement of vapor emissions as described in my copending application Ser. No. 603,002 in which the emissions to atmosphere of significant amounts of gasoline vapors at gasoline service stations was controlled and prevented. The disclosure of said copending application is incorporated herein.

The present invention contemplates an apparatus and method for controlling vapor emissions wherein pressure air is controlled by a plurality of pressure sensing means in the vent pipe of an underground storage system, provides combustion air, provides an air flow for pumping as by suction of gasoline vapors from the vent line, and provides means for operating control valve means in the vapor line for permitting flow of vapor to the burner means. The invention contemplates that in the absence of pressure air at the control valve in the vapor line, the valve will remain closed and will not be operable. In valve closed position, vapors are not passed to the burner means, the burner means is not supplied with air for combustion because of lack of pressure air in the system.

An object of the present invention is to provide an apparatus and method for abatement of vapor emissions at a gasoline service station in which novel safety features are provided.

Another object of the present invention is to provide such a vapor emission control system including multistage burner means operable under a preselected progressive set of below atmospheric pressure conditions in the vent line of the storage tanks in a gasoline service station.

Another object of the present invention is to provide an apparatus and method for vapor emission control including a pilot burner system utilizing gas vapors from the vent line of the gasoline storage tanks.

A still further object of the present invention is to provide an ignition means for the pilot burners having safety features whereby upon extinguishment of the pilot flame, supply of gas vapors to the pilot is stopped, electrical power supply is cut off and audible alarm means are actuated to alarm and inform the gas station operator of a malfunction.

A specific object of the present invention is to provide a method for abating vapor emissions wherein a closed system at below subatmospheric pressure is provided with pressure air under preselected pressure conditions to move vapors to a burning means, the control of such flow of vapors being only through the presence of pressure air which actuates a control valve in a vapor line.

A still further specific object of the present invention is to provide an apparatus for abatement of vapor emissions wherein a plurality of vapor carrying lines leading from a vent means of a storage tank to a plurality of burner means, each of said vapor lines having a control valve means, such control valve means being actuated only by pressure air introduced into said system in response to pressure sensing means at said vent means for the storage tank.

Various other advantages and objects of the present invention will be readily apparent from the following description in which the drawings illustrate an exemplary embodiment of the invention.

IN THE DRAWINGS

FIG. 1 is a schematic view of a gasoline service station illustrating transfer of liquid gasoline and gasoline vapors between a delivery tank truck and an underground storage tank and between the storage tank and an automobile tank through service station gasoline pumps and hoses, and the transfer of gasoline vapors through vent pipes to an incinerator means for burning excess vented gas vapors under preselected conditions.

Figure 1:
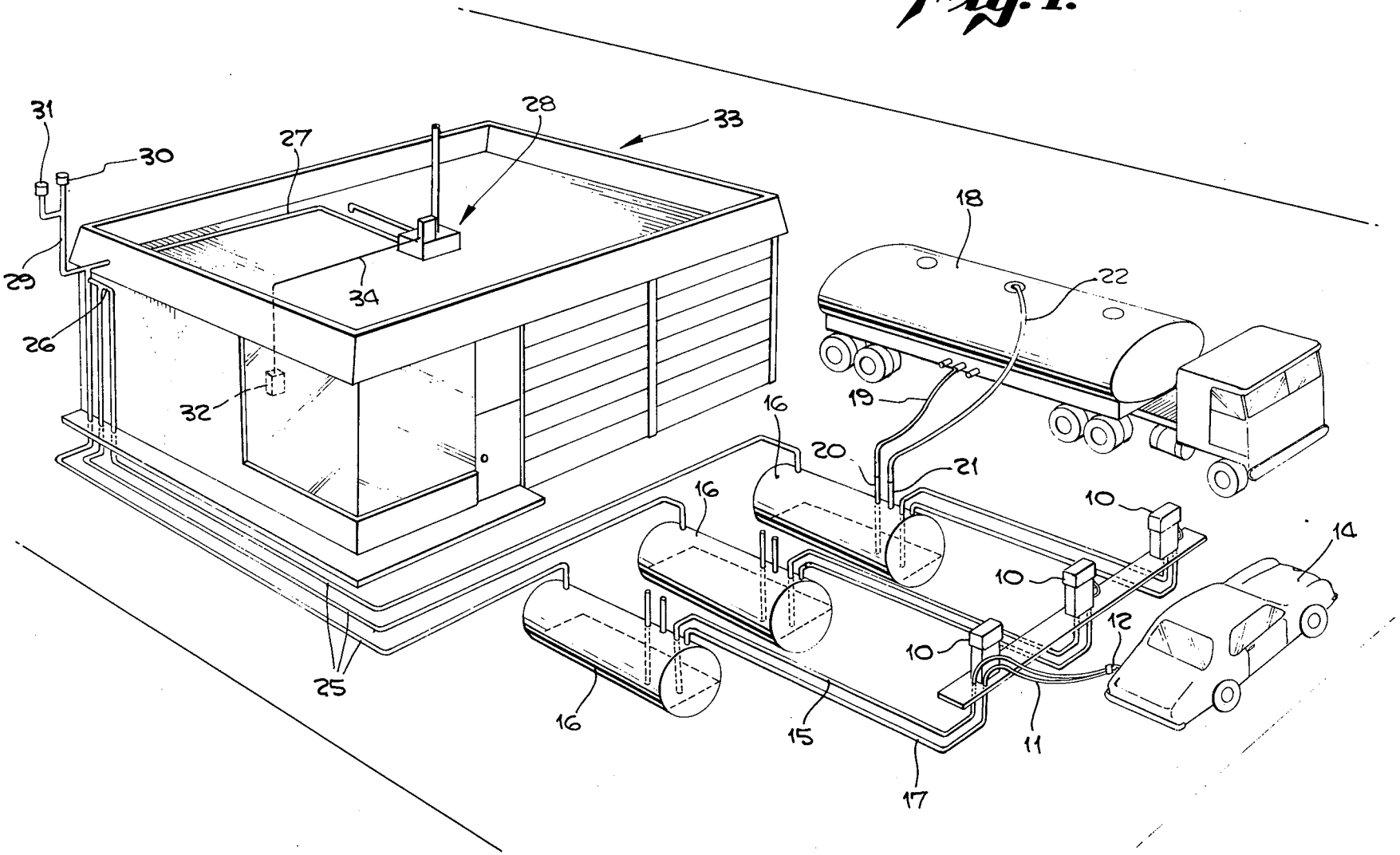

In FIG. 1 is generally schematically illustrated a gasoline service station having facilities for storage and dispensing of liquid gasoline and also for control and abatement of gasoline vapors in which excess vapors usually emitted to atmosphere are substantially eliminated. Generally speaking, the service station illustrated in FIG. 1 includes an arrangement described in my copending application Ser. No. 603,002, owned by a common assignee. The service station facilities and the apparatus and method of controlling vapor emissions which are common to said copending application will be first briefly described to facilitate the description and operation of the improvements thereto which are part of the present invention.

As disclosed in said copending application, a service station shown in FIG. 1 is provided with one or more gasoline pumps 10 each having dispensing hose means 11 with a nozzle 12 for insertion into a fill pipe for an automobile gasoline tank of an automobile 14. Hose means 11 is illustrated as having two hose lines connected to nozzle 12; however, hose means 11 may constitute one hose having two passageways therein, one of said passageways being for liquid gasoline transferred through line 15 from a storage tank 16 to the pump 10 and to the nozzle 12. The other hose line provides for passage of gasoline vapors from the automobile tank through pipe 17 to the storage tank 16. Nozzle 12 is of a type which has sealed relation with the fill pipe of the automobile tank. The vapor line 17 discharges vapor into the upper part of storage tank 16. It will be understood that tanks 16 are underground and each may have different levels of liquid gasoline therein depending upon the amount of liquid gasoline dispensed through their respective pumps 10. The piping arrangement between each of the tanks, associated gasoline pump 10, and hose means 11 are the same for each of the three tanks and only one will be described as above. FIG. 1 also illustrates the filling of an underground tank 16 by a gasoline tank truck 18 having a fill line 19 entering underground tank 16 through an upstanding fill riser 20 which discharges liquid gasoline adjacent to the bottom of tank 16. Tank 16 also has an upstanding vent riser 21 which may be coupled to a vent line 22 leading to the upper chamber portion of tank truck 18 so that vapor will be returned from tank 16 to the tank truck 18.

In each of the transfer systems generally described above; that is, between the automobile 14 and its gasoline storage tank and the underground storage tank 16 and between the tank truck 18 and an underground storage tank 16, the couplings and the lines are so constructed to provide a closed vapor tight circulation system for liquid gasoline and also vapors present in the system. Such transfer of gasoline vapors and liquids under a closed vapor tight sealed system prevents loss of gasoline vapors to atmosphere at the fill nozzle 12 and at the fill coupling of the tank truck 18 to the underground tank 16. Gasoline vapors accumulating in the upper portions of underground storage tanks 16 are permitted to flow through vent pipes 25, each connected to a tank 16, and manifolded at 26 to provide a flow path for excess gasoline vapors through vent pipe 27 which leads to a thermal oxidizer disposal means, generally indicated at 28, comprising a multistage burner means and ignition means therefor as later described. Adjacent the manifold 26 excess gasoline vapors are also connected to an upstanding vent riser 29 having a blowoff valve 30 at the top thereof and having a pressure vaccum valve 31 in communication with riser 29. Preferably, the generally horizontally disposed vent pipe 27 is pitched away from thermal oxidizer 28 so that condensate, which may occur in pipe 27, will be drained back to the manifold and toward the tanks 16. A remote control panel 32 may be located inside of the service station building schematically indicated at 33, said remote control panel 32 being connected to the thermal oxidizer 28 by cable 34.

Figure 2:
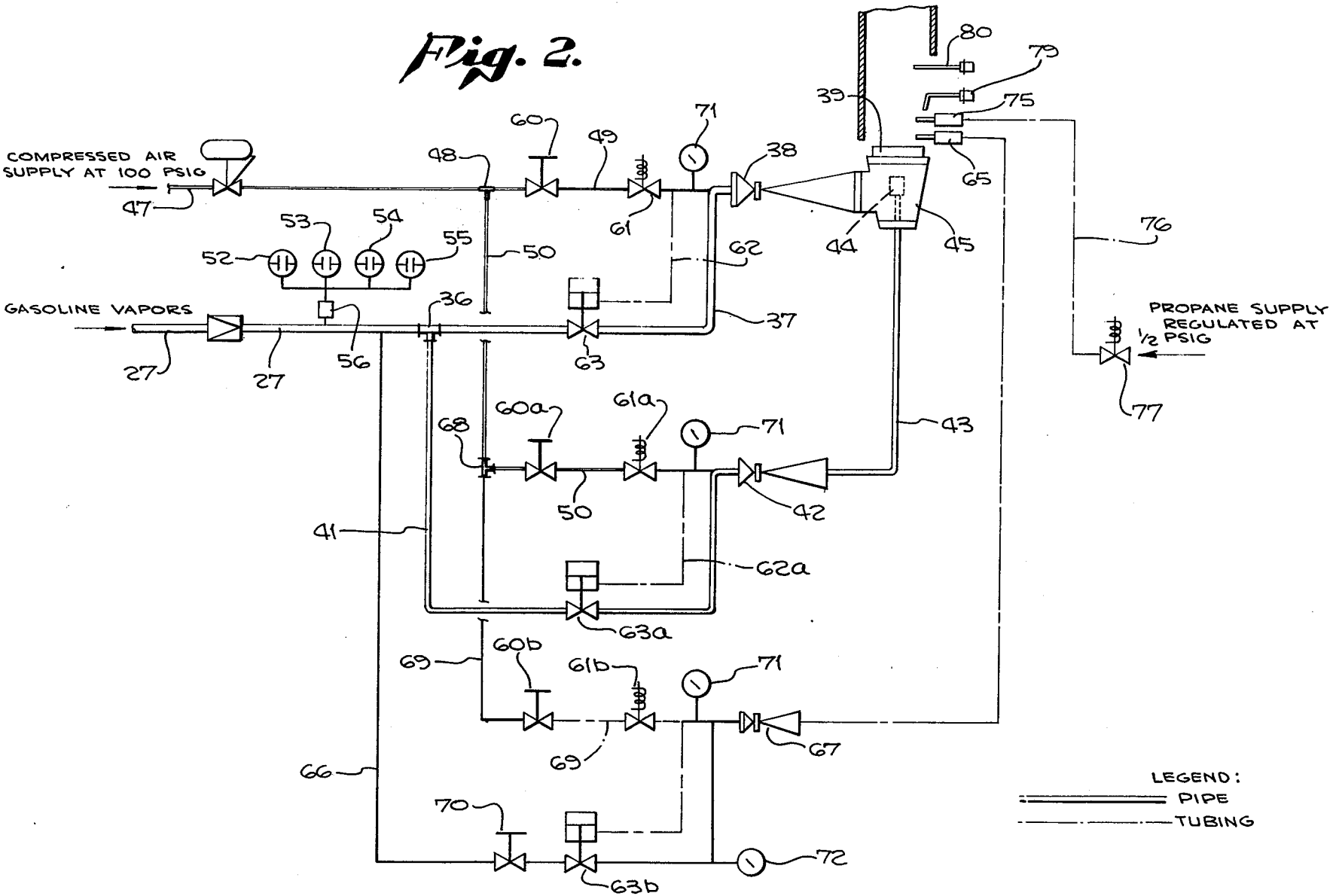
FIG. 2 is a schematic piping arrangement illustrating control of vent gas vapors from the underground storage tank.

FIG. 2 shows a schematic piping arrangement for such a thermal oxidizer and includes a piping arrangement, the parts of which that are common with the said copending application Ser. No. 603,002, including vent pipe 27 for the gasoline vapors, vent pipe 27 having a T connection 36 to divide gas vapor flow along vapor line 37 to an air gas booster 38 to a burner 39. Vapor line 41 extends from T 36 to an air gas booster 42 which discharges into a line 43 which leads to burner means 44 located within a reduction T 45.

The vapor emission control means also includes a compressed air source, not shown, which is generally available in gasoline service stations. The air compressor should have capability of supplying compressed air at 100 psig. A pressure air line 47 from said source is divided at a T 48 into a pressure air line 49 which leads to air gas booster 38 and supplies pressure air thereto.

At T 48, a second pressure air line 50 leads to and supplies pressure air to air booster 42.

Four pressure sensing valves 52, 53, 54 and 55 are manifolded and connected through a pressure snubber 56 to vent pipe 27 to sense the vapor pressure in vent pipe 27 and under varying pressure conditions to thereby cause actuation of the burner means 39 and 44.

The above description of the vapor emission control apparatus generally describes in part the apparatus of said copending application Ser. No. 603,002 now U.S. Pat. No. 4,009,985. In the following description, the apparatus and method of the present invention will be described in detail.

One of the important features of the present invention is the provision of pressure air actuated valves in the gasoline vapor lines thereby assuring that there will be no flow of gasoline vapor to the burner means, unless the compressed air source is operable and pressure air is available for moving the gas vapor to the burner means and providing sufficient combustion air to cause complete combustion of the vapor. In FIG. 2, pressure air line 49 is provided with a manually actuated globe valve 60 upstream from a solenoid actuated valve 61. Solenoid valve 61 is actuated by one of the pressure sensing valves as later described and when moved to open position, permits pressure air to flow into the air gas booster 38. An air line 62 connected to pressure air line 49 downstream from solenoid actuated valve 61 is in communication with an air actuated valve 63 provided in the gas vapor line 37 between T 36 and air gas booster 38. Pressure air communicating with valve 63 through line 62 causes actuation of valve 63 into open position to permit gas vapor to flow to air gas booster 38 and to burner 39.

The same arrangement is provided for burner means 44 wherein air line 50 is provided with a manually actuated globe valve **60*a* upstream from a solenoid actuated valve 61*a* and wherein an air line 62*a* communicates with an air actuated valve 63*a* in the gas vapor line 41 which leads to the air booster 42 and to the burner means 44**.

In the present invention, a similar system of air actuated valving is employed to provide a gasoline vapor pilot system in which the pressure air is used to pump gasoline vapor to a pilot burner 65. As best seen in FIG. 2, a gasoline vapor conducting tube 66 is connected to vent line 27 upstream of T 36 to provide a small amount of gasoline vapor to an air gas booster 67, which is connected to pilot burner means 65. Compressed air line 50 is provided with a T at 68 to divide pressure air in line 50 into line 69 for supplying a small amount of pressure air to air gas booster 67. As in the prior examples, pressure air line 69 may be provided with a manually actuated valve **60*b* and a solenoid actuated valve 61*b*. Downstream of valve 61*b*, a pressure air line 62*b* is connected to an air actuated valve 63*b* located in the pilot gasoline vapor line 66. A manually actuated valve 70 is provided in line 66 upstream of the air actuated valve 63*b***.

Each of the pressure air lines 49, 50, 69 may be provided with pressure gauges 71 upstream from their respective air gas boosters 38, 42 and 67. The pilot gas vapor line 66 may also be provided with a pressure gauge 72 upstream from air gas booster 67.

The pilot system described above includes the use of gasoline vapors and pressure air. FIG. 2 also shows a pilot system in which a pilot burner 75 is connected to a line 76 having a solenoid value 77 therein which regulates the supply of propane gas to burner 75, the source of the propane gas not being shown. The actuation of the propane pilot burner 75 may be controlled in a manner similar to that described in copending application Ser. No. 603,002.

In FIG. 2 a spark igniter 79 and a flame sensor 80 are shown in association with the pilot burners 65, 75 and with the burner means 39, 44, and 65.

Figure 4:
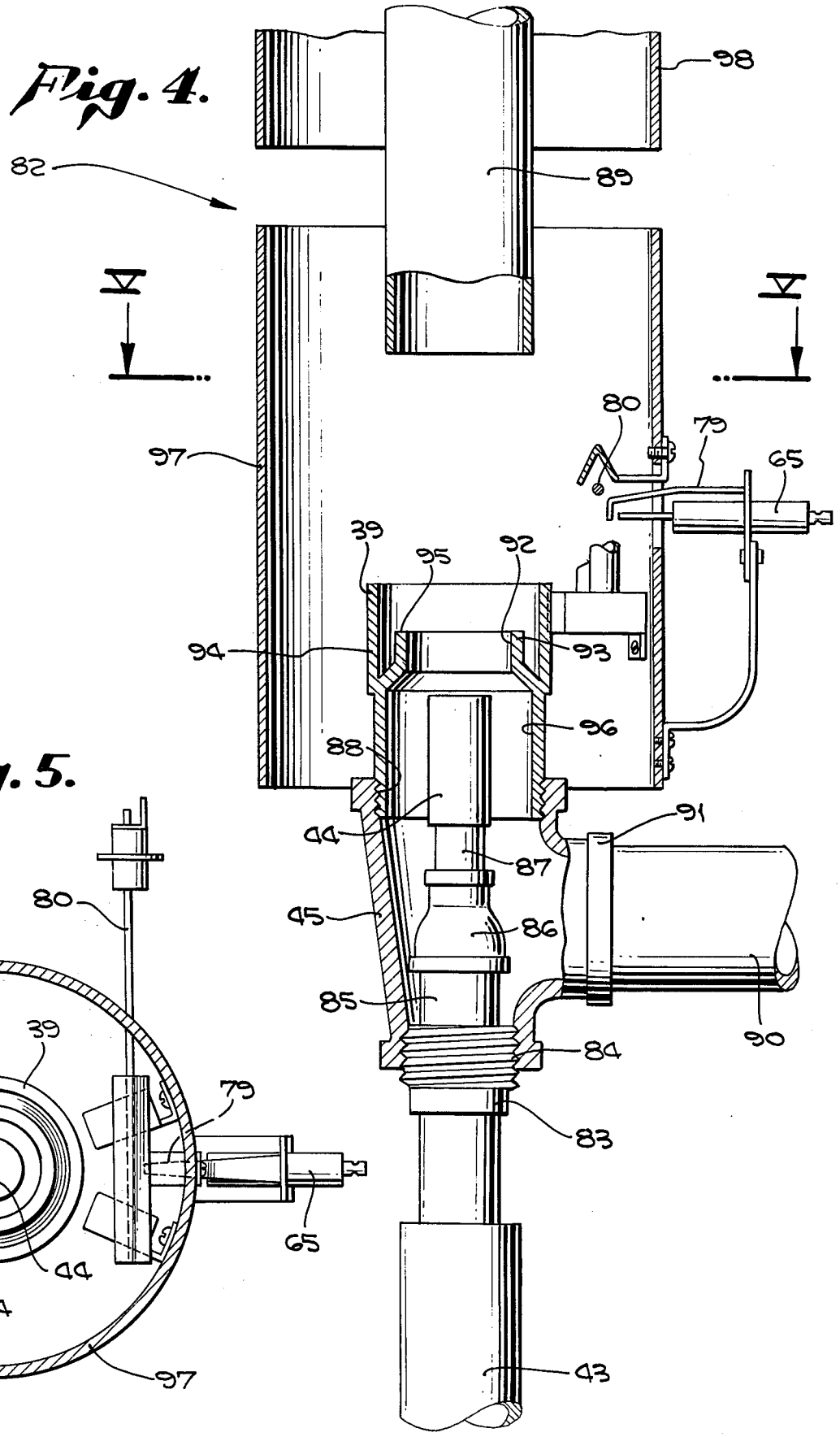
FIG. 4 is an enlarged fragmentary sectional view of burning means and ignition means therefor for complete combustion of gasoline vapors.
Figure 5:
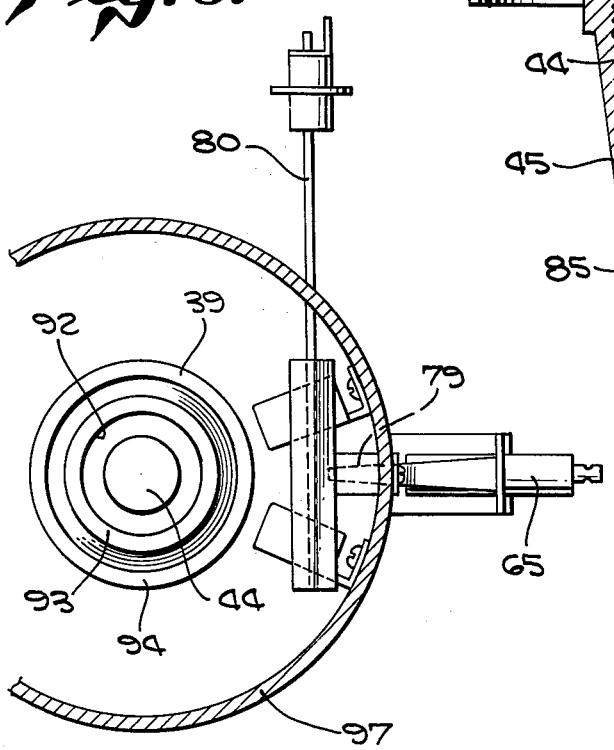
FIG. 5 is a transverse sectional view taken in the plane indicated by line V — V of FIG. 4.

In FIGS. 4 and 5 are shown details of the burner means 39 and 44 and their arrangement with dual stack means generally indicated at 82. Air vapor line 43 is provided with an externally threaded fitting 83 threaded into one of the threaded openings 84 of the reducing T 45. Within T 45, extension 85 of line 43 is provided with a reducing coupling 86 provided with a nipple 87 to which burner means 44 is attached. Burner means 44 has an axis which is coaxial with an enlarged internal threaded opening 88 of the reducing T 45. Air vapor flowing from line 43 into burner 44 is discharged in coaxial relationship with an inner stack pipe 89 having its lower end spaced from the burner 44.

In FIG. 4, line 90 is connected with the air gas booster 38 and introduces an air vapor mixture from booster 38 into the reducing T 45 through the reducing T opening at 91. Air vapor entering reducing T 45 flows around extension 87 and burner 44 and is discharged through an opening 92 defined by an inner wall 93 concentric to the axis of burner 44. Inner cylindrical wall 93 is encircled by an outer cylindrical wall 94 which extends axially a selected distance from the end face 95 of wall 93. Air vapor mixture entering opening 92 from the enlarged chamber 96 surrounding the burner 44 causes turbulence and mixing with the stream of air vapors discharged from burner 44 and flow of such mixture into the lower outer stack portion 97. Within the chamber defined by portion 97 is mounted the end of the pilot burner 65, the spark ignitor 79 and the flame sensor 80. The lower end of the inner stack pipe 89 extends within the upper portion of the lower enlarged stack portion 97. The upper stack portion 98 may be spaced from stack portion 97 a selected distance to permit the introduction of additional air into the enlarged defined by the upper stack portion 98 to provide a desired amount of air for accomplishing complete combustion of the air vapor mixture.

The arrangement of the dual stack means 82 and the burner means 39 and 44 is another embodiment of the dual stage burner means and dual stack means described in said copending application.

Figure 3:
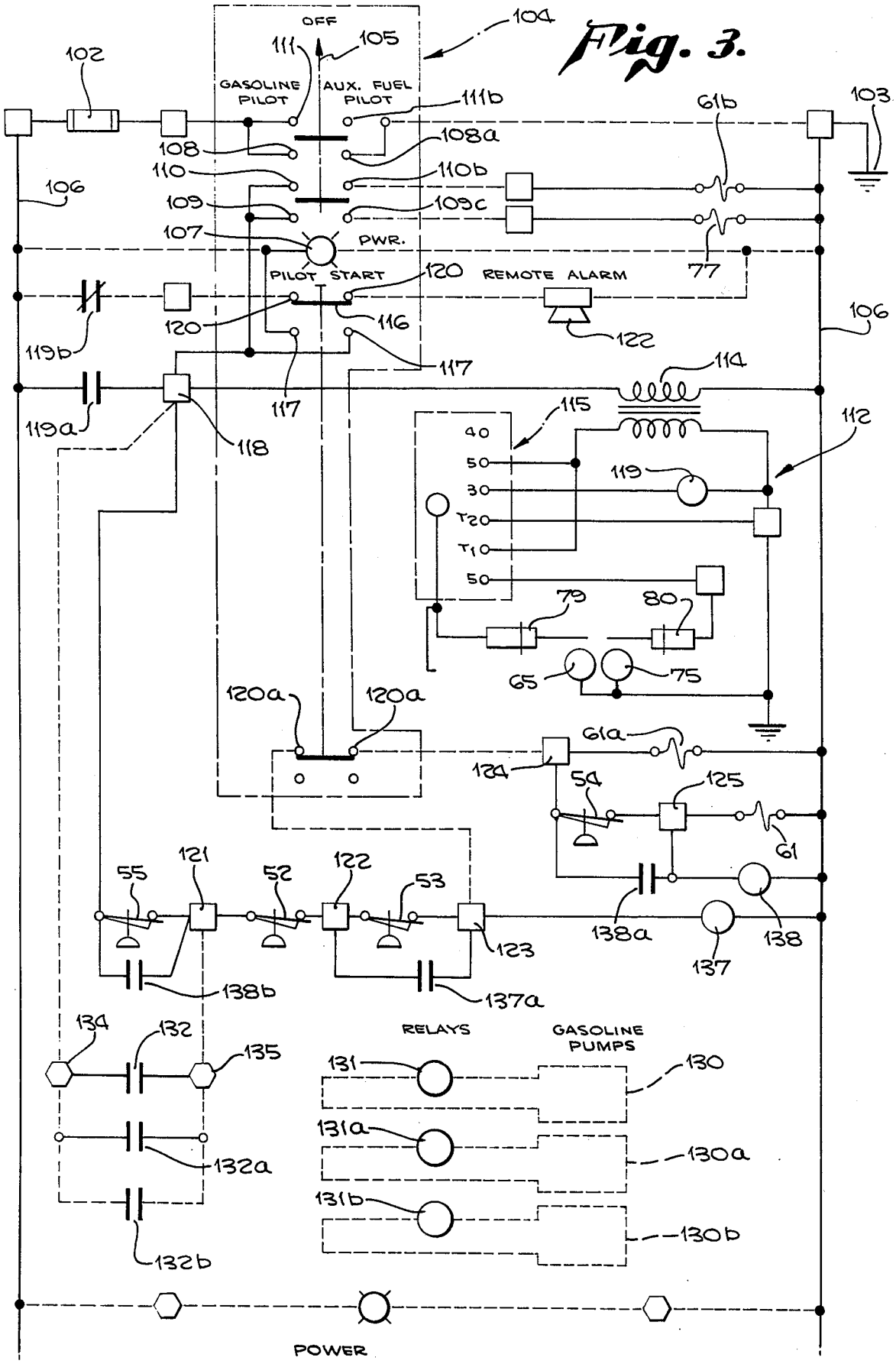
FIG. 3 is a schematic electrical diagram used with the control system shown in FIG. 2.

In FIG. 3, a schematic diagram is shown from which the operation of the multistage burner system described above will be readily apparent. The electric power supply may be a 120 volt 60 cycle 250 VA supply provided with a fuse 102, a ground 103, and remote control switching station generally indicated at 104. In the schematic of FIG. 3, the square boxes represent terminals in a local panel and the hexagonal symbols represent terminals in a remote relay panel. In the schematic of the switch means 104, it will be noted that switch means for the air vapor pilot means is shown, as well as the switch means for the auxiliarly fuel pilot or propane ignition means. Thus, in the switch means 104, on-off switch 105 is shown in an inoperative position with respect to solenoid valve means **61*b* in the pilot air line 69 and also in inoperative position with respect to the solenoid valve means 77 in the auxiliary propane supply line 76. Connected across the power leads 106 is a lamp 107. When switch 105 is in down position, the switch makes contacts with 108, 108***a* and 109, 109*c*. Contact with switch 109, 109*c* provides an ignition circuit for operation of the propane pilot means 75. When the switch means 105 is in upper position, the switch engages contacts 110 and 110*b* and 111 and 111*b*. Engagement with contacts 110 and 110*b* provides a circuit with solenoid valve means 61*b* in the pilot air line 69 for operation of the air vapor pilot means 65.

An electric ignition system is generally indicated at 112 and includes a transformer 114 supplying an ignition control panel generally indicated at 115 for control and operation of pilot burners 65 and 75 and the spark ignitor 79 and flame sensor 80. The electric ignition system 112 may be of well-known make and manufacture and in this example, schematically illustrates a Honeywell S-825D.

In operation of the ignition system 112, pilot start button 116 is pushed downwardly to engage contacts 117 to thereby provide a circuit through terminal 118 to energize transformer 114 and the ignition system 112. Energization of relay 119 causes normally open relay contacts 119*a* to close and thus provide a circuit through closed contacts 119*a*, terminal 118 and transformer 114. The pilot start button is a momentary contact and returns to engage contacts 120 and contacts 120*a* in the burner circuit later described. Normally closed relay contacts 119*b* are opened by the actuation of relay 119 when the pilot start button engages contacts 117.

In the event the flame at the pilot goes out, relay 119 is deactivated, relay contacts 119*b* return to closed position and complete a circuit through contacts 119*b*, the pilot starting button contacts 120 and remote alarm 122 to cause an audible alarm signal to be actuated for attracting the attention of the gas station attendant. Also, when relay 119 is deactivated, the closed contacts 119*a* are opened and the circuit through terminal 118 to the transformer 114 is broken. Opening of this circuit causes the circuits through the pressure sensing means 52, 53, 54 and 55 and solenoid valves 61, 61*a* to be opened (more fully described later), deactivating and shutting off vapor supply valves 63, 63*a*, and thus causing the entire system to be shut off.

In FIG. 3, pressure sensing means 55, 52, 53 and 54 are set to make contact to closed position as shown at respective negative vapor pressures of 0.65, 0.35, 0.15 and 0.10. Thus, a circuit is complete through closed contacts 119*a*, terminal 118, sensing means 55, terminal 121, sensing means 52, terminal 122, sensing means 53, terminal means 123, closed contacts 120*a* of the pilot start switch 116, terminal 124 and terminal 125, as more fully described hereafter. It will be noted that the arrangement of the sensing means 55, 52, 53 and 54 are shown in closed position and therefore indicate a condition in the vent line of slightly vacuum pressure or a vacuum pressure of less than 0.10.

To prevent emission of gasoline vapor at the pump nozzle, the entire storage system and vent system is maintained under a slight vacuum pressure so that vapor adjacent the nozzle during refueling of a vehicle will not be exhausted to atmosphere, but will be drawn into the storage system.

Assuming that no gasoline pump is in use and that the closed system is under a vacuum pressure of greater than 0.65, a condition wherein the sensing means 52–55 are in open position, then as vacuum pressure in the system diminishes to −0.65, pressure sensing means 52 will make and close its contacts. As vacuum pressure continues to diminish, pressure sensing means 53 will close its contacts at −0.35 pressure. Under a condition where one of the gasoline pumps 130, 130*a* or 130*b* is turned on, its respective relay 131, 131*a*, 131*b* will be activated to close relay contacts 132, 132*a* or 132*b* to provide a circuit between terminals 118, 134, closed contacts 132, terminal 135 and terminal 121. Since pressure sensing means 52 and 53 are closed, the circuit is also closed between terminals 121, 122, 123 and through the pilot start switch contacts 120*a* to terminal 124 for energizing solenoid valve means 61*a* which is located in the air line 50 for supplying air to the air valve 63*a* and to the air booster 42 for causing an air vapor mixture to flow to the small burner 44. Gasoline vapor flowing to the air gas booster 42 and through the air vapor line 43 to the small burner 44 is mixed with additional air to provide for proper combustion at the burner. The flame of burner 44 is directed into the smaller stack 89.

The suction pumping of the compressed air flowing into the air gas booster increases the vacuum pressure on the vent line 27 and the storage system associated therewith. As a result of the increased suction, pressure sensing means 53 breaks to open position. A holding relay 137, which was activated when the circuit was made by turning a gas pump on, closed relay contacts 137*a* to maintain a holding circuit between terminal 123 and terminal 122 when the pressure sensing means 53 opened. The small burner 44 will continue to operate until the preset negative pressure of 0.65 is reached in the system at which point pressure sensing means 52 will break open, thus opening the circuit which energized solenoid valve 61*a* and thus closing the air valve 63*a* which was supplying vapor to the small burner. The first stage or small burner 44 is thus stopped.

In the event the first stage burner 44 has been ignited and is operating as described above and the condition of the pressure vacuum in the storage system continues to diminish, then pressure sensing means 54 will make at 0.15 negative pressure to close the circuit through terminals 124 and 125 to energize solenoid valve means 61. Energization of solenoid valve means 61 introduces pressure air into line 62 which actuates air valve 63 to supply gasoline vapor through line 37 and air through line 49 to the air gas booster 38 which conducts the air gas mixture to the larger burner 39. At the large burner 39 the air gas mixture is ignited and is discharged into the larger stack 98 together with the air gas mixture being burned at the small burner 44. When the solenoid valve means 61 for the large burner was energized, a holding relay 138 was also activated to close contacts 138*a* to provide a holding circuit which bypasses the pressure sensing means 54.

With both air gas boosters 42 and 38 in operation supplying air gas mixture to both burners 44 and 39, the vacuum pressure of the vent line 27 and the storage system increases. Since pressure sensing means 54 is set at a negative vacuum pressure of 0.15 as the vacuum pressure increases, this switch will break open first; but the circuit will remain energized because of the bypass relay contacts 138*a* and both burners 39 and 44 will continue to operate until the increasing vacuum pressure exceeds −0.65 when the pressure sensing means 52 will break open and thus break the circuit and cause both burners 39 and 44 to stop.

As mentioned above, the storage system is maintained at a slightly negative pressure. The operation of the system under gasoline pump on conditions has been described. In the event no gasoline pump is turned on, the burners are not activated until the vacuum diminishes to a negative pressure of 0.10 at which pressure the pressure sensing means 55 makes and closes the circuit through terminals 118, 121, 122, 123, 124 and 125. Both burners are activated as described above. Relay 138, when activated by the making of the pressure sensing means 55, also activates relay contacts **138*b* which provides a holding circuit bypassing the pressure sensing means 55 and the circuit is thus maintained with both burners in operation until the vacuum pressure in the closed system increases to above 0.65 at which point the pressure sensing switch means 52** breaks open and thereby deactivates both of the burners as above described.

It is important to note that the operation of the system, as above described, maintains a constant vacuum on the storage system under all conditions of operation and thereby inhibits the introduction of gasoline vapors to atmosphere during transfer of liquid gasoline to or from the underground storage tanks. It should also be noted that the pressure sensing means are preset in a predetermined diminishing vacuum pressure sequence to provide selective operation of the small and larger burners of the multistage burner means. Thus, the system provides an effective means for meeting the vapor demands of the storage system, the small burner being only activated when necessary and both burners being activated when necessary to increase the vacuum pressure in the system to the preselected desirable pressure. As noted above, the system is intended to maintain a vacuum pressure of slightly greater than 0.65.

It is also important to note that the system is inoperable in the absence of pressure air. Without the required pressure air available, the air ignition system is inoperable and also there is no air to permit flow of gasoline vapors to the air gas boosters and the burners.

It should also be noted that the ignition system for the burners includes a flame safeguard means whereby if the pilot flame is extinguished, gas supply to the pilot is simultaneously stopped and electrical power supply to the solenoid valves is cut off and an audible alarm signal is produced to notify the gas station operator of this condition. Suitable flame arrestors are provided in the vapor lines so that in the event of a flame flashback the arrestor will stop the flame from entering the vent lines.

Various modifications and changes may be made in the vapor emission control system described above and all such changes and modifications coming within the scope of the appended claims are embraced thereby.

I claim:

1. In a method of abatement of vapors emitted from a storage container during transfer of fluids including liquids and vapors to or from said container, said storage container having a vent means to atmosphere and wherein pressure of said vapors in said vent means is sensed to cause such vapors to be directed at a preselected pressure along a path to a burning means, a pressure air source providing combustion air which is directed to said burner means when said preselected vapor pressure is sensed, and igniting and burning a mixture of vapors and air at said burning means, including the steps of:

providing a valve means in the path of said vapors to said burning means for controlling flow of said vapors;

and actuating said valve means by pressure air from said air source only when such pressure air is available to pump said vapors to said burner means.

2. A method as stated in claim 1 including the steps of:

providing a second valve means in a vapor line communicating with pilot means for said burner means, and actuating said second valve means by pressure air from said pressure air source whereby said pilot means will receive vapor only when said pressure air is available for pumping and burning said vapor.

3. In a method of abatement of vapor emitted from storage containers during transfer of fluids including liquids and gas to or from said containers, said fluids in said storage containers being subject to changes in pressure, temperature and volume, and at least one of said storage containers having a vent means to atmosphere, and wherein pressure of said vapor in said vent means is sensed to cause such vapor to be directed along a path to a multistage burning means at a preselected vapor pressure, a pressure air source supplying air to move said gas and combustion air to said burner means when said preselected vapor pressure is sensed, and igniting and burning the mixture of vapor and air at said burner means including the steps of:

sensing vapor pressure in said vapor vent line at a plurality of preselected below atmospheric pressures;

causing vapors in said vent line to be directed to a multistage burner means and pilot means at preselected sensed pressures; and controlling flow of said vapors to said burner means and pilot means by pressure air, said pressure air serving to pump said vapors to said burner means and said pilot means and to supply combustion air thereto.

4. In a vapor emission control apparatus for a gasoline service station having a gas pump adapted to be connected in sealed relation to a gasoline vehicle tank to provide a closed vapor system between said gas pump, vehicle gas tank, and storage supply tanks, a vent means to atmosphere for said closed system, a pressure air source, and multistage burner means including a pilot means, the combination of:

a plurality of preset pressure sensing means in communication with said vent line for maintaining said closed vapor system at subatmospheric pressures;

a first vapor carrying line leading from said vent means to a first stage of said burner means, a second vapor carrying line leading from said vent means to a second burner means;

a pressure air line supplying pressure air to said first burner means and a second pressure air line supplying pressure air to said second burner means;

solenoid valve means in said first and second pressure air lines operable by said pressure sensing means;

and air actuated valve means in each of said first and second vapor carrying lines, said air actuated valve means being actuated by pressure air communicating therewith from said respective first and second pressure air lines adjacent to and downstream of said solenoid valve means in said pressure air lines.

5. An apparatus as stated in claim 4 including:

a pilot burner means; a third vapor carrying line leading from said vent means to said pilot burner means; a third pressure air line supplying pressure air to said pilot burner means;

a solenoid valve means in said third pressure air line;

electrical ignition means for said pilot means;

and valve means in said third vapor carrying line actuated by pressure air communicating with said third pressure air line downstream from said third solenoid valve means.

6. An apparatus as stated in claim 4 wherein said plurality of preset pressure sensing means are preset to progressively sense diminishing vacuum conditions in said vent means to maintain said closed system under subatmospheric pressure condition.

7. In an apparatus as stated in claim 6 including an electrical ignition means for said burner means;

means for energizing said ignition system upon operation of a gas pump at said station;

and means in said electrical ignition means for shutting off vapor supply to said burner means.

8. In an apparatus as stated in claim 7 wherein said electrical ignition means includes an alarm means operable when said vapor supply is shut off.

9. An apparatus as stated in claim 4 wherein said pressure sensing means, in the absence of gasoline pump operation, is operable to maintain said system at a subatmospheric pressure condition.

10. In a vapor emission control apparatus for a gasoline service station having a gas pump with a gas hose adapted to be connected in substantially sealed relation to a gasoline vehicle tank to provide a substantially closed vapor system between said gas pump, gas hose, vehicle gas tank, and storage supply tanks, a pressure air source and a disposal means in selective communication with said vapor system, the combination of:

preset pressure sensing means in communication with said closed vapor system for maintaining said vapor system at a selected pressure; a vapor carrying line leading from said vapor system to said disposal means;

and actuating valve means in said vapor carrying line actuated by pressure air communicating therewith from said pressure air source when said pressure air is available to move vapors in said vapor system to said disposal means.

11. In a method of abatement of vapors produced in a storage container during transfer of fluids including liquids and vapors to or from said container, said storage container having a vent means to atmosphere and having communication with a vapor conducting line leading to a disposal means and wherein pressure of vapors is sensed to cause such vapors to be directed at preselected pressure along a path to said disposal means, and a pressure air source actuated when a preselected vapor pressure is sensed, including the steps of:

providing a valve means in the vapor conducting line to said disposal means;

and actuating said valve means by pressure air from said air source only when such pressure air is available to move said vapors along said vapor conducting line to said disposal means.

* * * * *